United States Patent [19]

Wehling et al.

[11] Patent Number: 4,919,680

[45] Date of Patent: Apr. 24, 1990

[54] HIGH-EXTRACTION CHROME TANNING PROCESS

[75] Inventors: Bernhard Wehling; Bernd Makowka, both of Bergisch-Gladbach; Heinz-Günter Klein, deceased, late of Bergisch-Gladbach; Gertrud Klein, heir, Cologne; Helga Rosentreter, Leverkusen, all of Fed. Rep. of Germany

[73] Assignee: Bayer Aktiengesellschaft, Leverkusen, Fed. Rep. of Germany

[21] Appl. No.: 231,233

[22] Filed: Aug. 11, 1988

[30] Foreign Application Priority Data

Aug. 12, 1987 [DE] Fed. Rep. of Germany ..... 3726796

[51] Int. Cl.[5] ..... C14C 3/06

[52] U.S. Cl. ..... 8/94.27; 8/94.26; 8/94.25

[58] Field of Search ..... 8/94.26, 94.27; 252/8.57

[56] References Cited

U.S. PATENT DOCUMENTS 4,042,321 8/1977 Backer et al. ..... 8/94.26
4,101,271 7/1978 Bockelman et al. ..... 8/94.27
4,126,413 11/1978 Traubel et al. ..... 8/94.27

FOREIGN PATENT DOCUMENTS 3636002 4/1988 Fed. Rep. of Germany ..... 8/94.27
2271290 5/1975 France .

*Primary Examiner*—Paul Lieberman
*Assistant Examiner*—John F. McNally
*Attorney, Agent, or Firm*—Connolly and Hutz

[57] ABSTRACT

Crome tanning of pickled animal hides with a tanning agent comprising a reaction product of a basic chromium (III) sulfate and aliphatic $C_4$–$C_6$ dicarboxylic acids or their salts is improved by preparing the reaction product in an aqueous solution from basic chromium (III) sulfate and 0.2 to 0.8 mol of the aliphatic dicarboxylic acids per mol chromium oxide of the basic chromium sulfate with subsequent adjustment of the theoretical basicity to 0 to 50% with alkali metal hydroxide or carbonate, the reaction product being added to a hide pickling liquor in the form of an aqueous solution having a chromium oxide content of at least 5% or in powder form in a quantity of 0.9 to 1.5% chromium oxide, based on hide weight, with a liquor volume less than 100%, based on hide weight, the final pH value being above 4.0 and the final temperature above 40° C.

6 Claims, No Drawings

HIGH-EXTRACTION CHROME TANNING PROCESS

The present invention relates to an improved process for high-extraction chrome tanning of animal hides.

BACKGROUND OF THE INVENTION

Efforts to improve the environmental situation around leather factories are very much concerned with reducing the chromium content of the wastewater. In addition to the recovery of unused chromium from residual tanning and retanning liquors, high-extraction chrome tanning processes have been adopted with a view to achieving this objective (K. Faber, Bibliothek des Leders, Vol. 3, pages 158 et seq, UmschauVerlag, Frankfurt/Main, 1st Edition, 1985). In Faber excesses of chromium which are not actually required and which always have to be circulated are not used for tanning as they are in recycling processes. Instead, only that quantity of chromium which is needed to establish the desired chromium content in the leather is used for tanning. Accordingly, the residual tanning and retaining liquors contain only small quantities of chromium.

To improve the extraction of chromium, it has been proposed, inter alia, to use so-called crosslinking aliphatic dicarboxylic acids, such as for example succinic acid, adipic acid and glutaric acid, for pickling or for chrome tanning (see for example Das Leder 23 (1972), 174 et seq; Das Leder 28 (1977), 155 et seq; Leder- und Häutemarkt 30 (1978), 132 et seq).

The aliphatic dicarboxylic acids are added to the chrome tanning liquor after the chrome tanning material in the form of their disodium salts. Although the extraction of chromium is distinctly improved in relation to a conventional tanning process, the quality of the leather can nevertheless be adversely affected (cf. K. Faber, loc. cit., page 83). The distribution of chromium and dyeability are impaired, particularly with thick or unskived hides. Another negative factor is that, in the described process, the penetration of the chrome tanning agent through the skin cross-section is impeded by the presence of the dicarboxylic acids (Leder- und Häutemarkt 30 (1978) 140).

To improve the situation, it is recommended to work at final pH values in the tanning liquor below 4.0 and at final temperatures of around 40° C. However, this only provides for extraction levels of up to 95% (Das Leder 28 (1977), 157).

In addition, it is recommended to add the dicarboxylic acid salts in several portions. However, this is an additional complication of the chrome tanning process.

The difficulties described above are eliminated by the process described in German 2,424,301, in which tanning mixtures consisting of chromium(III) salts, acid-binding agents and aliphatic $C_4$–$C_6$ dicarboxylic acids or salts thereof are initially used together with conventional chrome tanning agents for chrome tanning. To obtain high extraction, at least 1.6 mol dicarboxylic acid has to be used per mol chromium oxide in the tanning mixture for full tanning.

In addition, it is known that solutions of chromium-(III) salts and sodium adipate can be used for the chrome tanning of calf skins (Journal of the International Society of Leather Trades Chemists 27 (1943), 83 et seq). In this case, however, more than 1.5% chromium oxide (based on pickle weight, corresponds to considerably more than 1.5% chromium oxide, based on skin weight) has to be used to obtain an adequate tanning effect (boil dressing). The chrome liquors used have a chromium oxide content of at most only 2.8% and are therefore unsuitable for use on a commercial scale. Where more than 1.5% chromium oxide (based on pickle weight) is available, the extraction of chromium is distinctly in excess of 1.0 g chromium oxide/l.

Accordingly, in all hitherto known high-extraction chrome tanning processes where aliphatic dicarboxylic acids are co-used, the total quantity of chrome tanning material and the dicarboxylic acids always have to be added to the liquor in unreacted form in at least two portions.

BRIEF DESCRIPTION OF THE INVENTION

It has now been found that high extraction chrome tanning with uniform distribution of the chromium throughout the leather can be carried out with only one addition of the total quantity of the chrome tanning material and the dicarboxylic acids providing the pickled hides are chrome-tanned with a reaction product of a basic chromium sulfate and 0.2 to 0.8 mol/mol chromium oxide of the basic chromium sultat of an aliphatic $C_4$–$C_6$ dicarboxylic acid or mixtures thereof.

DETAILED DESCRIPTION OF THE INVENTION

The present high-extraction chrome tanning of pickled animal hides is achieved with a tanning agent comprising a reaction product of a basic chromium (III) sulfate and aliphatic $C_4$–$C_6$ dicarboylic acids or their salts wherein the reaction product is prepared in an aqueous solution from basic chromium (III) sulfate and 0.2 to 0.8 mol of the aliphatic dicarboxylic acids per mol chromium oxide of the basic chromium sulfate with subsequent adjustment of the theoretical basicity to 0 to 50% alkali metal hydroxyde or carbonate, the reaction product being added to hide pickling liquor in the form of an aqueous solution having a chromium oxide content of at least 5% or in powder form in a quantity of 0.9 to 1.5% chromium oxide, based on hide weight, with a float volume less than 100%, based on hide weight, the final pH value being above 4.0 and the final temperature above 40° C. In addition, the reaction product of basic chromium (III) sulfate and dicarboxylic aids may contain monocarboxylic acids, such as formic acid or acetic acid as masking agents.

In one preferred embodiment of the process, the reaction product used in accordance with the invention, referred to hereinafter as a chromium-dicaroxylate complex, is dried and optionally mixed with the usual acid-binding agents.

The process according to the invention is carried out in a liquor volume of less than 100% and preferably 10 to 50% (based on hide weight) at a final pH value above 4.0 and preferably from 4.2 to 4.6 and at a final temperature above 40° C. and preferably from 42° to 50° C. If the chromium-dicarboxylate complex is not used together with acid-binding agents in the chrome tanning liquor, alkalis are used in the usual way for basification to the desired pH value. The term alkali is intended to mean the hydroxides and carbonates of alkali metals such as lithium, sodium, and potassium, as well as ammonia.

The chromium oxide content of the residual chrome tanning liquors obtained in the process according to the invention is below 1 g/l.

The chromium-dicarboxylate complex is prepared by reaction of basic chromium(III) sulfates withe the corresponding aliphatic $C_4$–$C_6$ dicarboxylic acids or mixtures thereof in aqueous solution for 30 to 80 minutes at temperatures of 50° to 100° C. The desired theoretical basicity of 0 to 50% is then adjusted with alkali solution, preferably with soda solution (for calculation of the theoretical basicity, see German 3,519,287).

The chromium-dicarboxylate complex thus obtained may be used in the existing solution for chrome tanning. In one preferred embodiment of the process, the solution is concentrated by evaporation and preferably spray-dried. The powder-form tanning material obtained in this way may be used for chrome tanning either as such or in admixture with acid-binding agents.

Suitable basic chromium(III) sulfates are the reaction products of hexavalent chromium compounds with reducing agents normally used in chrome tanning (cf. K. Faber, loc. cit., page 83). They may additionally contain monocarboxylic acids (for example formic or acetic acid) or salts thereof as masking agents.

The chromium oxide content of the solutions according to the invention should be at least 5% and preferably 10 to 15%.

Aliphatic $C_4$–$C_6$ dicarboxylic acids are, for example, succinic, glutaric, adipic, maleic, fumaric, aspartic and glutamic acid and mixtures thereof. It is preferred to use glutaric acid and adipic acid or mixtures of these acids, optionally together with other dicarboxylic acids.

Suitable acid-binding agents (basifying agents) are, for example, dolomite, alkali carbonates and bicarbonates and magnesium oxides.

The mineral double salt $CaCO_3.MgCO_3$, which has a CaO content of 20 to 40% CaO and preferably 25 to 35% CaO and an MgO content of 10 to 25% and preferably 16 to 24% MgO, is used as dolomite.

Mixtures containing at least 40% of the total quantity of acid-binding agents used in the form of dolomite and/or low-reactivity magnesium oxides are particularly suitable.

Low-reactivity magnesium oxides are, for example, commercially available products, such as ®TAN-BASE (a product of Steetley Quarry Products Ltd.) or ®NEUTRIGAN MO (a product of BASF).

The chromium-dicarboxylate complexes according to the invention are also suitable for use in the retanning of chrome leathers. In this case, 0.3 to 1.5% chromium oxide (based on sharing weight) is available.

The value of the process according to the invention lies primarily in the fact that the use of the chromium-dicarboxylate complex according to the invention provides for high extraction levels in chrome tanning coupled with a particularly simple procedure involving very little effort without the quality of the leather being adversely affected. Residual liquors containing less than 1 g chromium oxide/l are obtained for only a single addition of chrome tanning material and dicarboxylic acid. It was not foreseeable that the use of the chromium-dicarboxylate complexes according to the invention would greatly improve tanning or that such high extraction levels would be obtained, despite the small quantity of dicarboxylic acid, based on the chromium available.

The process according to the invention is illustrated by the following Examples in which percentages are percentages by weight unless otherwise indicated.

EXAMPLE 1

In a 1000 liter reactor, 722 kg of a chromium(III) sulfate solution having a basicity of 33.2% (according to Stiasny) and a chromium(III) oxide content of 16.8% are heated to 80° C. 42 kg technical glutaric acid (40% glutaric acid, 30% succinic acid and 30% adipic acid) are added, followed by stirring for 30 minutes. After addition of 100 ml polysiloxane-based foam inhibitor (foam inhibitor E 100, a product of Bayer AG), 347 kg of a 3N soda solution are pumped in over a period of about 120 minutes. The reaction solution is then stirred for 60 minutes at 80° C. and has a theoretical basicity of 40% for a chromium oxide content of 10.9%. The solution is then dried while still hot in a spray dryer (entry temperature: 185° C., exit temperature: 120° C.). 490 kg chromium-dicarboxylic complex containing 24% chromium oxide and 0.4 mol technical glutaric acid per mol chromium oxide and having a theoretical basicity of 40% are obtained.

EXAMPLE 2

In a 1 $m^3$ stirred reactor, 735 kg of a chromium(III) sulfate solution having a basicity of 33.2% (according to Stiasny) and a chromium oxide content of 15.6% are heated to around 80° C. and reacted with 64 kg technical glutaric acid. After stirring for 30 minutes at 80° C., the chrome tanning solution (basicity 13%, chromium oxide content 15.2%) is dried in a spray dryer (entry temperature: 185° C., exit temperature: 115° C.). 485 kg chromium-dicarboxylate complex tanning material having a theoretical basicity of 13% and a chromium oxide content of 23.5% (molar ratio of chromium oxide to glutaric acid 1:0.6) are obtained.

EXAMPLE 3

In a 1 $m^3$ stirred reactor, 700 kg of a solution of chromium sulfate having a basicity of 33.2% (according to Stiasny) and a $Cr_2O_3$ content of 18% are heated to a temperature of 80° C. 43.8 kg of a mixture consisting of 32% succinic acid, 39% glutaric acid and 29% adipic acid are then dissolved therein, followed by stirring for 30 minutes. The liquid mixture obtained has a theoretical basicity of approximately 20% and a $Cr_2O_3$ content of 16.9%; the molar ratio of chromium oxide to dicarboxylic acid is 1:0.4. The quantities used for the preparation of other chromium-dicarboxylate complex tanning materials suitable for use in liquid form are shown in the following Table as Examples 3a–3d (method of preparation as in Example 3).

| Example | Molar ratio $Cr_2O_3$: glutaric acid | pbw* chromium sulfate sol.** | pbw* glutaric acid | Basicity | % $Cr_2O_3$ |
|---|---|---|---|---|---|
| 3a | 1:0.2 | 700 | 21.9 | 26.5% | 17.5 |
| 3b | 1:0.3 | 700 | 32.8 | 23.2% | 17.2 |
| 3c | 1:0.6 | 700 | 65.6 | 13.2% | 16.5 |

-continued

| Example | Molar ratio $Cr_2O_3$: glutaric acid | pbw* chromium sulfate sol.** | pbw* glutaric acid | Basicity | % $Cr_2O_3$ |
|---|---|---|---|---|---|
| 3d | 1:0.8 | 700 | 87.5 | 6.5% | 16.0 |

*pbw = parts by weight
**composition as in Example 3

EXAMPLE 4

In a 1000 liter reactor, 750 kg of a 33.2% basic chromium(III) sulfate solution having a chromium oxide content of 16.2% are heated to around 90° C. 70 kg adipic acid are then added, followed by stirring with heating for 30 minutes. After addition of a commercial foam inhibitor (E 100, a product of Bayer AG), 343 kg of a 20% soda solution are pumped in over a period of 180 minutes. The reaction solution is then stirred with heating for 60 minutes. It has a theoretical basicity of approximately 40% and a chromium oxide content of 10.4%. The still hot, liquid tanning mixture is then spray-dried (entry temperature: 180° C., exit temperature: 118° C.).

A chromium-dicarboxylate tanning material containing 22.8% chromium oxide and 0.6 mol adipic acid per mol chromium oxide and having a theoretical basicity of approximately 40% is obtained.

EXAMPLE 5

To make shoe upper leather, 100 kg cowhides (unskived) limed in the usual way are first washed for 10 minutes with 150% (based on hide weight) water at 38° C. in a tanning drum (diameter 2 m, width 2.25 m, rotational speed 12 r.p.m.). The liquor is drained off and, after deliming for 60 minutes with 2.5% ammonium sulfate, 0.3% sodium bisulfate and 0.4% formic acid in the absence of liquor, 50% water at 35° C. is added and the hides bated for 50 minutes with 0.5% of a standard commercial bate (1500 trypt. units), pH value of solution 7.5. The cross-section of the hides produces no further red coloration with phenolphthalein. The hides are then washed twice with 150% water at 20° C. and the liquor is drained off to a residual liquor of around 50%. 5 minutes after the addition of 6% sodium chloride, 1.6% sulfuric acid (diluted 1:10) are added and the hides are pickled for 120 minutes (pH 1.8).

6.7% of the tanning mixture described below are added to the pickling solution, followed by tumbling for another 20 hours. The final pH is 4.5 and the final temperature 50° C.

The residual liquor contains 0.6 g chromium oxide/l. On examination after skiving, the chrome leathers show outstanding full tanning. Finishing in the usual way gives upper leathers having a soft, full feel, a fine grain and very even coloring.

The tanning mixture used consists of:

800 parts of the powder-form chromium-dicarboxylic complex prepared in accordance with Example 1 and 174 parts dolomite.

The chromium oxide content is 19.7%.

EXAMPLE 6

7 parts of the tanning mixture described below are added to 100 parts cowhides pretreated as in Example 5, followed by tumbling for 20 hours. The final pH is 4.6 and the final temperature 48° C. The residual liquor contains 0.6 g $Cr_2O_3$/l.

The tanning mixture used, which has a $Cr_2O_3$ content of 18.6%, has the following composition:

100 parts of the chromium-dicarboxylate complex tanning material prepared in accordance with Example 2,
5 parts TANBASE (Steetley, Gt. Britain) and
21 parts dolomite.

EXAMPLE 7

7.9 parts of a chromium-dicarboxylate complex solution prepared in accordance with Example 2 are added to 100 parts cowhides pretreated as in Example 5. After 1 hour, the tanning liquor is basified with 1.8% soda (dissolved in a ratio of 1:15) in 1 hour, followed by further tumbling for 15 hours. The final temperature is 46° C. and the final pH value 4.3. The residual liquor contains 0.5 g $Cr_2O_3$/l.

EXAMPLE 8

Corresponding cowhide halves pretreated as in Example 5 up to and including pickling are comparatively chrome-tanned.

100 parts hides of one half A are tumbled for 20 hours with 7.6 parts of the tanning mixture described below. Composition of the tanning mixture containing 17.4% chromium oxide (molar ratio of $Cr_2O_3$ to glutaric acid 1:0.4) for A: 500 parts of a powder-form 33% basic chromium(III) sulfate containing 26% chromium oxide.
45 parts techn. glutaric acid,
86 parts sodium bicarbonate,
118 parts dolomite.

The final tanning temperature is 42° C. and the final pH value 4.3. The residual liquor contains 0.6 g $Cr_2O_3$/l.

100 parts cowhides of the corresponding half B are treated for 20 hours with 6.7 parts of the following mixture: Composition of the mixture containing 19.7% $Cr_2O_3$ for B: 80 parts of the chromium-dicarboxylate complex prepared in accordance with Example 1 and 18 parts dolomite.

The temperature reached at the end of the tanning process is 42° C. and the final pH value 4.3. The residual liquor has a chromium oxide content of 0.8 g/l.

By comparison with B, the leathers of the corresponding pieces A show much poorer full tanning after skiving.

The dye finishes subsequently applied in the usual way are also distinctly less uniform in the case of A.

EXAMPLE 9

For the production of upper leather, 3000 kg cowhides (skived to approx. 3.5 mm) limed in the usual way are first washed for 10 minutes with 150% (based on hide weight) water at 38° C. in a tanning drum (diameter 3 m, width 3 m, rotational speed 5 and 10 r.p.m.). The liquor is drained off and, after deliming for 30 minutes with 30% water at 35° C. containing 2% ammonium sulfate, 0.2% sodium bisulfate and 0.2% formic acid, the hides are bated for 30 minutes with 0.5% of a standard commercial bate (1500 tryptic units), pH value of the solution 8.3.

The cross-section of the hides produces no further red coloration with phenolphthalein. The hides are then washed twice with 150% water at 20° C. and the liquor drained off to a residual liquor of approximately 20%. 5 minutes after the addition of 4% sodium chloride, 0.5% formic acid (diluted in a ratio of 1:5) and, after 10 minutes, 0.8% sulfuric acid (diluted in a ratio of 1:10) are added and the hides pickled for 60 minutes (pH 2.7). 8.1% of the chromium-dicarboxylate complex solution prepared in accordance with Example 3d are pumped into the pickling solution.

After 1 hour, the liquor is basified with 2.2% soda (dissolved in water in a ratio of 1:15) in 6 portions in 1 hour, after which tumbling is continued for 18 hours.

Towards the end of the tanning process, the temperature is 40° C. and the pH value 4.0. The residual liquor has a chromium(III) oxide concentration of 0.4 g/l.

Finishing in the usual way gives full, soft leathers distinguished by an extremely even dye finish.

EXAMPLE 10

6.7 parts of the tanning mixture described below are added to 100 parts cowhides pretreated as in Example 9 (skived to approx. 3.5 mm) in the pickling solution.

The tanning mixture, which has a $Cr_2O_3$ content of 21.0%. has the following composition:

100 parts of the chromium-dicarboxylate complex tanning material produced in accordance with Example 4 and 8.5 parts TANBASE.

The final pH value is 4.3 and the final temperature 45° C. The residual liquor contains 0.5 g/l $Cr_2O_3$.

EXAMPLE 11

To make furniture leather, 300 kg cowhides (skived to approx. 2 mm) limed in the usual way are first washed for 10 minutes with 150% (based on hide weight) water at 38° C. in a tanning drum (diameter 3 m, width 3 m, rotational speed 5 and 10 r.p.m.). The liquor is drained off and, after deliming for 40 minutes with 50% water at 35° C. containing 2.5% ammonium chloride, 0.3% sodium bisulfite and 0.2% formic acid, the hides are bated for 45 minutes with 0.7% of a standard commercial bate (1500 tryptic units), pH value of the solution 8.5.

The cross-section of the hides produces no further red coloration with phenolphthalein. The hides are then washed twice with 150% water at 20° C. and the liquor drained off to a residual liquor of approximately 50%. 5 minutes after addition of 6% sodium chloride, 1.1% sulfuric acid (diluted 1:10) is added and the hides pickled for 120 minutes (pH 2.7).

6.3% of the tanning solution described in Example 3 is added to the pickling solution and, after 1 hour, the liquor is basified in 1 hour with 1.4% soda (dissolved in a ratio of 1:15), followed by further tumbling for 15 hours. The final pH is 4.2 and the final temperature 45° C.

The residual liquor contains 0.2 g/l chromium oxide. Finishing in the usual way gives furniture leather having a soft feel and very even dye finishes.

EXAMPLE 12

5.5 parts of the tanning mixture described below are added to 100 parts cowhides (skived to approx. 2 mm) limed, delimed, bated and pickled as in Example 11 in the pickling solution, followed by further tumbling for 18 hours. The final pH value is 4.5 and the final temperature 45° C. The residual liquor has a chromium oxide content of 0.3 g/l. Composition of the powder-form tanning mixture containing 19% $Cr_2O_3$:

750 parts of a chromium-dicarboxylate complex tanning material prepared in accordance with Example 4 and 151 parts dolomite.

EXAMPLE 13

500 kg wet blues (sharing thickness 1.5) are tumbled for 90 minutes in a tanning drum (diameter 2.5 m, width 2 m, rotational speed 12 r.p.m.) with 200% water at 55° C. and 2.5% (based on sharing weight) of the tanning mixture described in Example 5 with a chromium oxide content of 19.7% and then circulated for 5 minutes every hour overnight via an automatic switch mechanism. The chrome retanning liquor has a pH value of 4.6 and contains 0.1 g $Cr_2O_3$/l. The leathers are finished in the usual way for upper leather. Very evenly dyed, grain-stable upper leathers are obtained.

EXAMPLE 14

100 parts cowhides (skived to 3.5 mm) pretreated as in Example 9 are tanned in the pickling solution with 6.75 parts of the following tanning mixture:

500 parts of the chromium-dicarboxylate complex tanning material produced in accordance with Example 1 and 101 parts dolomite.

$Cr_2O_3$ content: 20%.

After tumbling for 12 hours, the final temperature was 42° C. for a final pH value of 4.1. The liquor contains 0.9 g $Cr_2O_3$ per liter.

What is claimed is:

1. In an improved process for the chrome tanning of pickled hides with a tanning agent comprising a reaction product of a basic chromium (III) sulfate and aliphatic $C_4$–$C_6$ dicarboxylic acids or salts thereof, the improvement comprises preparing said reaction product in an aqueous solution from basic chromium (III) sulfate and 0.2 to 0.8 mol of the aliphatic dicarboxylic acids per mol chromium oxide of the basic chromium sulfate to 50° to 100° C. over a period of 30 to 180 minutes with subsequent adjustment of the theoretical basicity to 0 to 50% with alkali metal hydroxide or carbonate, the reaction product being added to a hide pickling liquor in the form of an aqueous solution having a chromium oxide content of at least 5% or in powder form in a quantity of 0.9 to 1.5% chromium oxide, based on hide weight, the liquor volume comprising less than 100%, based on hide weight, the final pH value being above 4.0 and the final temperature above 40° C.

2. A process as claimed in claim 1 wherein the reaction product is added to the hide pickling solution in the form of a spray-dried product.

3. A process as claimed in claim 1 wherein said reaction product is in spray-dried form in admixture with acid-binding agents.

4. A process as claimed in claim 3 wherein the acid-binding agent comprises dolomite.

5. A process as claimed in claim 3 wherein the acid-binding agent comprises low-reactivity magnesium oxide.

6. A process as claimed in claim 1 wherein said $C_4$–$C_6$ dicarboxylic acids comprise a technical mixture of glutaric, succinic and adipic acid.

* * * * *